US007437837B2

(12) United States Patent
Jacobs

(10) Patent No.: US 7,437,837 B2
(45) Date of Patent: Oct. 21, 2008

(54) CORD AND STRAP COMBINATION SHOE CLOSURE

(76) Inventor: Laura Michelle Jacobs, 812 Broadway, #5, New York, NY (US) 10003

( * ) Notice: Subject to any disclaimer, the term of this patent is extended or adjusted under 35 U.S.C. 154(b) by 387 days.

(21) Appl. No.: 11/172,296

(22) Filed: Jun. 30, 2005

(65) Prior Publication Data

US 2005/0235525 A1 Oct. 27, 2005

Related U.S. Application Data

(63) Continuation-in-part of application No. 10/614,225, filed on Jul. 7, 2003, now abandoned.

(60) Provisional application No. 60/393,968, filed on Jul. 5, 2002.

(51) Int. Cl.
*A43B 5/04* (2006.01)
*A43K 11/00* (2006.01)

(52) U.S. Cl. ..... 36/50.1; 36/50.5

(58) Field of Classification Search ..... 36/50.1, 36/50.5, 88, 133

See application file for complete search history.

(56) References Cited

U.S. PATENT DOCUMENTS

| | | | | | |
|---|---|---|---|---|---|
| 2,539,026 | A | * | 1/1951 | Mangold | 36/117.8 |
| 2,925,672 | A | * | 2/1960 | Trovato | 36/50.1 |
| 4,079,527 | A | * | 3/1978 | Antonious | 36/51 |
| 4,114,297 | A | * | 9/1978 | Famolare, Jr. | 36/50.1 |
| 4,282,657 | A | | 8/1981 | Antonious | 36/50 |
| 4,296,558 | A | | 10/1981 | Antonious | 36/50 |
| 4,308,672 | A | | 1/1982 | Antonious | 36/50 |
| 4,550,511 | A | * | 11/1985 | Gamm | 36/50.1 |
| D281,927 | S | | 12/1985 | Hill | D2/310 |
| 4,566,207 | A | * | 1/1986 | Struntz | 36/50.1 |
| 4,592,154 | A | * | 6/1986 | Oatman | 36/114 |
| 4,642,914 | A | | 2/1987 | Caldeira | 36/50.1 |
| RE32,585 | E | | 2/1988 | Antonious | 36/50 |
| 4,766,682 | A | * | 8/1988 | Malloy, III | 36/132 |
| 4,907,352 | A | | 3/1990 | Ginsberg | 36/50.1 |
| 5,269,078 | A | * | 12/1993 | Cochrane | 36/93 |
| 5,353,483 | A | | 10/1994 | Louviere | 24/712.1 |
| 5,379,529 | A | | 1/1995 | Smith et al. | 36/54 |
| 5,564,203 | A | * | 10/1996 | Morris | 36/50.1 |
| 5,659,982 | A | | 8/1997 | Muraoka et al. | 36/50.1 |
| 5,819,439 | A | * | 10/1998 | Sanchez | 36/89 |
| 5,907,912 | A | | 6/1999 | Alaimo | 36/50.1 |
| 6,026,594 | A | * | 2/2000 | Fougere | 36/50.5 |
| 6,073,370 | A | * | 6/2000 | Okajima | 36/50.1 |

(Continued)

FOREIGN PATENT DOCUMENTS

WO WO 94/09662 A1 5/1994

*Primary Examiner*—Marie Patterson
(74) *Attorney, Agent, or Firm*—Cohen Pontani Lieberman & Pavane LLP

(57) ABSTRACT

A footwear closure assembly and method including multiple closure systems that may be selected from by a wearer including a first closure device having a removable cord and openings for receiving the cord to secure closure of the footwear; and a second closure device including a removable strap and slots for receiving the strap. The closure assembly is provided such that the wearer may select from among the various closure devices including the first closure device, the second closure device, or both first and second closure devices providing increased versatility for the wearer.

10 Claims, 13 Drawing Sheets

U.S. PATENT DOCUMENTS 6,119,372 A * 9/2000 Okajima ..... 36/50.1
6,467,193 B1 * 10/2002 Okajima ..... 36/10
6,505,424 B2 * 1/2003 Oorei et al. ..... 36/129
6,510,627 B1 1/2003 Liu ..... 36/50.1
7,062,867 B2 * 6/2006 Meibock ..... 36/50.1
7,131,219 B2 * 11/2006 Chen et al. ..... 36/89
2004/0181973 A1 * 9/2004 Meibock ..... 36/50.5

* cited by examiner

CORD AND STRAP COMBINATION SHOE CLOSURE

CROSS-REFERENCE

This application is a continuation-in-part and claims the benefit of the filing date of U.S. patent application Ser. No. 10/614,225 filed Jul. 7, 2003 now abandoned, which claims the benefit of the filing date of U.S. Provisional Patent Application Ser. No. 60/393,968 filed Jul. 5, 2002.

FIELD OF THE INVENTION

The present invention relates to shoe closure apparatus and method. More particularly, the present invention relates to a shoe closure apparatus and method that offers several combinations of closure.

BACKGROUND OF THE INVENTION

Various shoe closure means have been utilized for many years. Shoes closures, such as for example, Velcro® hook and loop fasteners, have been utilized to replace and/or reinforce/augment traditional shoe-lace closures on many varieties of shoes, whether athletic, orthopedic, or everyday-wear shoes. When used to completely or partially replace laces, a Velcro® hook and loop fastener provides the benefit of ease of fastening for those who may have difficulty due to age or limited use of their hands. When used in conjunction with laces, Velcro® hook and loop fasteners typically cinch and add additional support to certain areas of the foot, such as the arch or serve to cover and maintain the laces as a fail-safe. This typically requires that the Velcro® hook and loop fastener, such as a strap, be fixedly attached to the shoe. Examples of these systems are illustrated in U.S. Pat. No. 4,114,297 to Famolare, Jr.; U.S. Pat. No. 4,308,672 to Antonious; U.S. Pat. No. 5,379,529 to Smith et al. These closure means are used in conjunction with the shoe laces and are non-removable fixed to the shoe itself. This does not give the wearer more than one option when fastening closed their shoes.

Another design is disclosed in U.S. Pat. No. 6,505,424 (the '424 patent) to Oorei et al., which teaches use of an athletic shoe with plurality of band-shaped member secured by means of laces over the instep and a tightening belt that extends downward and around a heel of the shoe and over the instep of the shoe. However, the '424 patent also fails to give the user the option to use either the laces or the strap connection, rather the user must use the laces to engage with the band-shaped members and the tightening belt so that the athletic shoe is tightly contacted with the heel portion of a wearer. (Col. 2, line 53). This however, disadvantageously does not allow the user to choose from a plurality of fastening options as the user must use both laces and strap.

While Velcro® hooks and loop fastener straps have been used in conjunction with or to replace traditional shoe-lace closures, there remains a need for a closure apparatus which allows the wearer to choose from several closure varieties. There remains a need for strap closures which are removable from the shoe itself and allows the wearer the option of using them.

SUMMARY OF THE INVENTION

What is desired then is a shoe closure apparatus that allows the user the option to choose from a plurality of closure means.

It is further desired to provide a shoe closure apparatus that allows the user to change the look and feel of a selected closure means.

It is still further desired to provide a shoe closure apparatus that provides for additional support to certain areas of the foot.

These and other objects are achieved in one advantageous embodiment of the present invention in which a footwear closure assembly comprises a cord-receiving system disposed in footwear such as a shoe, a cord is received by the cord-receiving system, at least one pair of slots may be disposed in the footwear adjacent to the cord-receiving system. The assembly may further comprise at least one strap that is received by the pair of slots in an installed position. The strap is provided with fasteners at each of its ends that may be disposed on opposite surfaces of the ends of the straps.

It should be noted that the fasteners may comprise many different types of connection devices including for example, but not limited to Velcro® hook and loop fasteners, snapping buckles, cinching webs and the like. It is contemplated that many different types of fasteners may effectively be utilized providing even greater versatility to the user. It should also be noted that in one embodiment, the removability of the strap and/or the cords or laces provides even greater versatility. These features further provide a benefit to manufacturers as fewer patterns/dies are required because the versatility associated with each shoe. Retailer and buyers can also purchase one shoe, not either/or, or both, cord closure shoe or strap closure shoe because both features may be realized independently in one shoe. This highly versatile shoe allows the user to use the cord closure, the strap closure, or both. A competitive edge and an incentive to purchase this shoe is created because of the versatility of closures in one single shoe, instead of similar shoes with only a single closure.

In one advantageous embodiment a footwear closure system for securing closure of the footwear by various closure devices is provided comprising, an upper portion of the footwear, a first closure device, and a second closure device. The first closure device includes, openings provided in the upper portion, and a cord, positioned in the openings in the upper portion, the cord being removable from the openings. The second closure device includes, at least two slots, located in the upper portion, a strap having first and second ends, each end provided with fasteners for connection to each other, and the strap is removably insertable in the at least two slots such that the fasteners may engage with each other to secure closure of the footwear. The footwear closure system is provided where a wearer is provided with a versatile closure system such that the user may select from among either: the first closure device, the second closure device, or both the first and the second closure device as the closure system for the footwear.

In another advantageous embodiment a footwear closure system for securing closure of the footwear by various closure devices is provided comprising, an upper portion of the footwear, a first closure device, and a second closure device. The first closure device includes, openings provided in the upper portion, and a cord, positioned in the openings in the upper portion, the cord being removable from the openings. The second closure device includes, at least two slots, located in the upper portion, at least two loops, attached to the footwear and extending through the at least two slots respectively, a strap including at least two buckles for engaging with the at least two-loops, and the strap is removably connected to the at least two loops. The footwear closure system is provided where a wearer is provided with a versatile closure system such that the user may select from among either: the first closure device, the second closure device, or both the first and the second closure device as the closure system for the footwear.

Other objects of the invention and its particular features and advantages will become more apparent from consideration of the following drawings and accompanying detailed description.

DETAILED DESCRIPTION OF THE DRAWINGS

Figure 1:
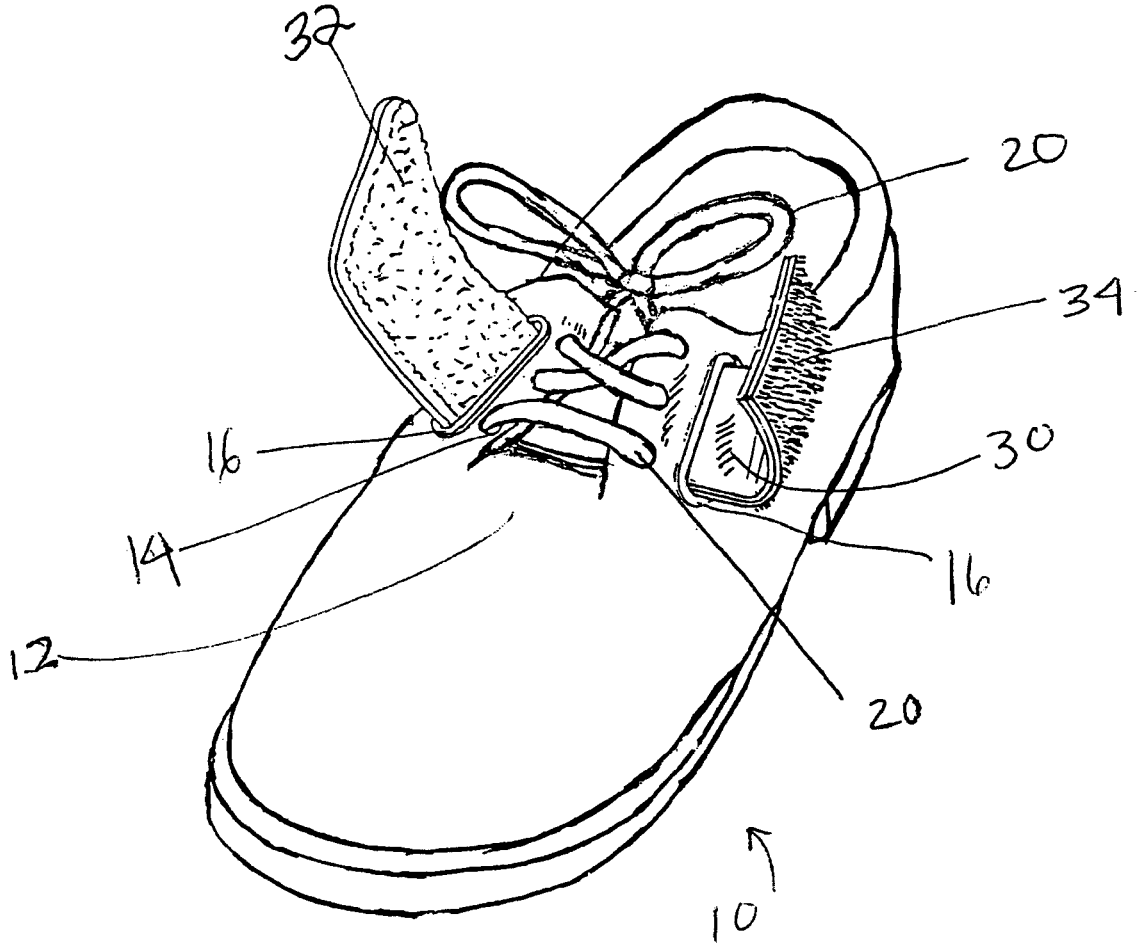
FIG. 1 is a front perspective view one advantageous embodiment of the invention.

Referring now to the drawings, wherein like reference numerals designate corresponding structure throughout the views.

The present invention provides a combination cord and strap combination shoe closure as illustrated in FIGS. 1-9. Shoes made according to the invention may include for example but is not limited to: holes, slots, loops, eyelets, grommets or other means for attaching removable cords or laces, or attaching a removable strap(s) or belts, or combination thereof for creating tension and closing a shoe about a wearer's foot.

FIG. 1 shows generally a shoe 10 with a closure assembly including a cord 20 and strap 30. Both the cord 20 and strap 30 are removable and may be used in various combinations to achieve closure of any type of shoe, such as orthopedic shoes, athletic sneakers, sandals, and other footwear requiring a closure or cinching assembly to secure it to the wearer's foot.

Cord 20 is threaded through a cord-receiving system, which may include but not limited to for example eyelets, holes, D-rings, loops, grommets, or the like disposed in the upper 12 of the shoe 10 in its installed position. Cord 20 may be a shoe-lace, ribbon, chord or the like that may be tied, knotted or otherwise clamped or cinched into a closed and/or secured position, for example, using a locking mechanism such as a sleeve lock or such.

Figure 2:
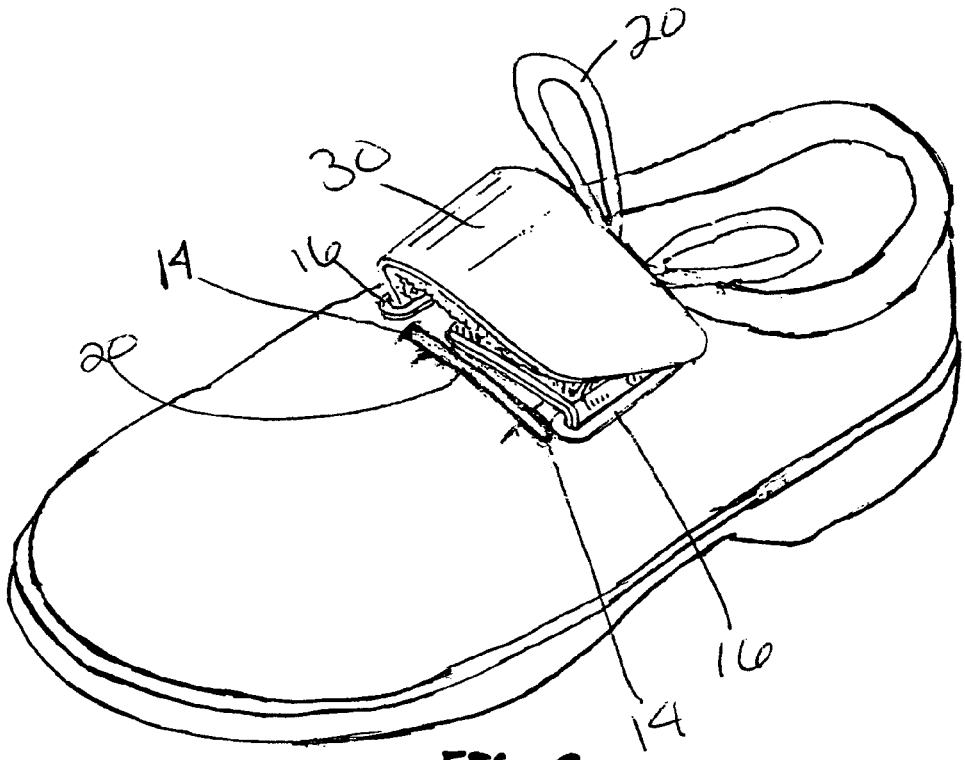
FIG. 2 is front perspective view of the advantageous embodiment according to FIG. 1.

Strap 30 is slid through slots or grommets 16 disposed in the upper 12, adjacent to cord-receiving system 10. In an installed position, strap 30 is positioned through upper 12 via grommets 16. Strap 30 may be made of leather, vinyl, nylon, cloth, canvas or any other suitable material. Strap 30 further includes a fastener, which in one embodiment may comprise a hook and loop fastener disposed at each end 32, 34 of strap 30 and may further be positioned on opposite sides of strap 30. In this manner, strap 30 may be folded over on itself and fastened into its closed position, as shown in FIG. 2. A Velcro® hook and loop fastener allows for strap 30 to be folded upon itself, with adjustment for more or less overlap at ends 32, 34, and control over the extent that strap 30 closes or cinches shoe 10 and/or supports the foot therein by pulling the medial and lateral sides of upper together. It should be noted that in one advantageous embodiment strap 30 may be positioned or threaded under cord 20 but attaches at each 32, 34 on top of cord 20. In this particular embodiments strap 30 is simple and easy to install/remove piece that does not include buckles, which may inhibit quick and easy installation/removal from shoe 10.

It is contemplated however, that other coupling means such as clips, snaps, buckles, hooks and eyes, and the like could also be used to secure strap 30 to itself and/or to upper 12 for secure closing of shoe 10.

Strap 30 may further be adjustable in length by use of a ring-and-slide adjustment or similar mechanism known in the art. Ring and slide adjustment is advantageous because it allows the user to adjust the strap length after it has been placed a closed position in the upper 12, allowing for the user to make a tighter or looser fit of the strap 30 about the assembly.

It is further contemplated that strap 30 may partially, or may entirely, cover cord 20 depending on relative adjacent placement of cord-receiving system 14 and grommets 16 within the upper 12 of the shoe 10. Cord-receiving system 14 and grommets 16 may be placed accordingly within the upper 12 to provide the desired support to a particular area of the foot.

Referring to FIG. 2, cord 20 and strap 30 are illustrated both in a closed position to secure the shoe to wearer's foot and to provide to the wearer increased support due to the redundant closure systems.

Figure 3:
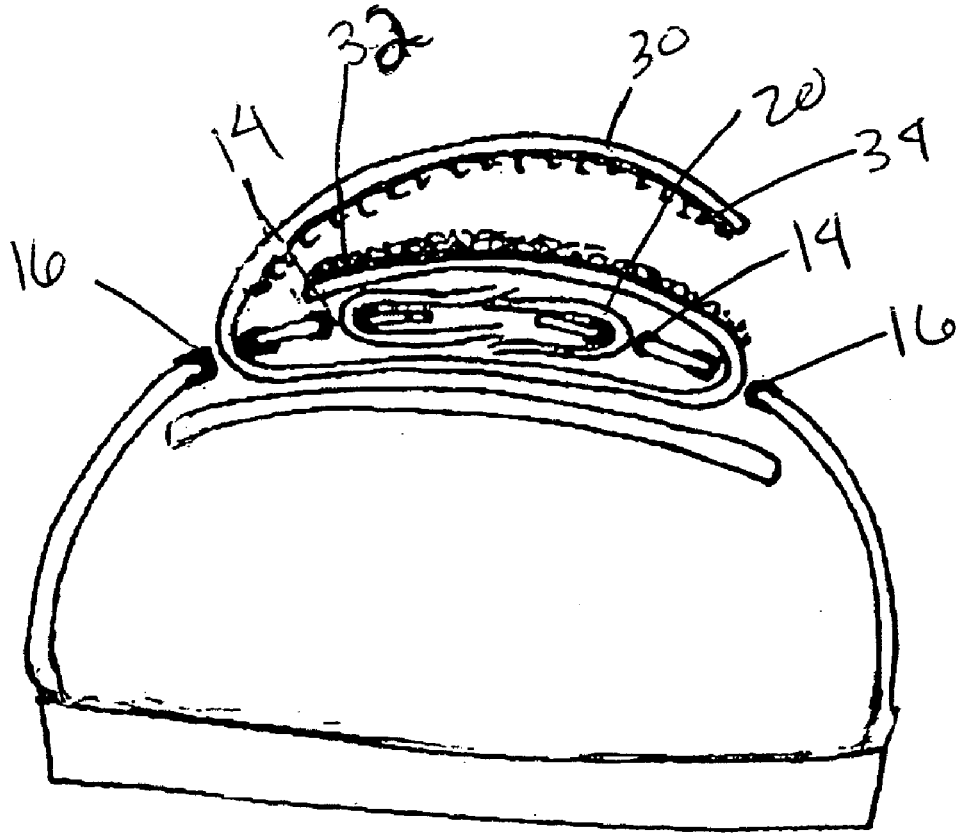
FIG. 3 is a front view of the advantageous embodiment according to FIG. 1.

FIG. 3 illustrates shoe 12 as a front elevational view. Here, cord 20 shown in an in installed position, has been threaded through cord-receiving system 14. Additionally, strap 30 also shown in an installed position, has been slid through grommets 16, underneath cord 20, and folded upon itself and attached at its end regions 32, 34. Adjustability of both cord 20 and strap 30 is a simple matter of tying cord 20 tighter or looser and/or pulling strap 30 tighter or looser.

Figure 4:
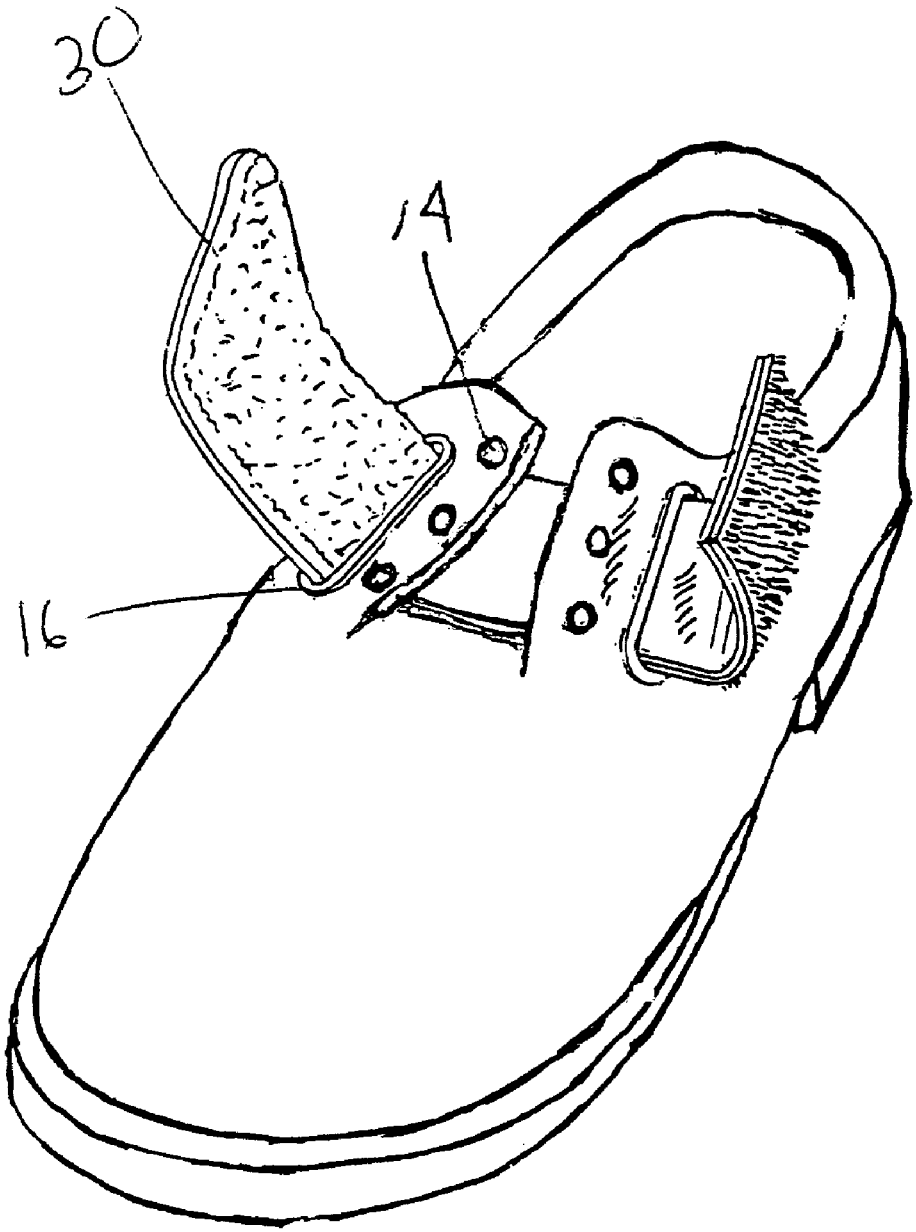
FIG. 4 is front perspective view of the advantageous embodiment according to FIG. 1 showing the chords removed.

FIG. 4 illustrates cord 20 removed and strap 30 slid through grommets 16 in an installed, but open position. While cord-receiving system 14 are disposed in upper 12 and provide the option of additionally using cord or lace, closure of shoe may be achieved by strap 30 alone. This feature allows the user to select only the strap 30 closure feature providing greater versatility to the user.

Figure 5:
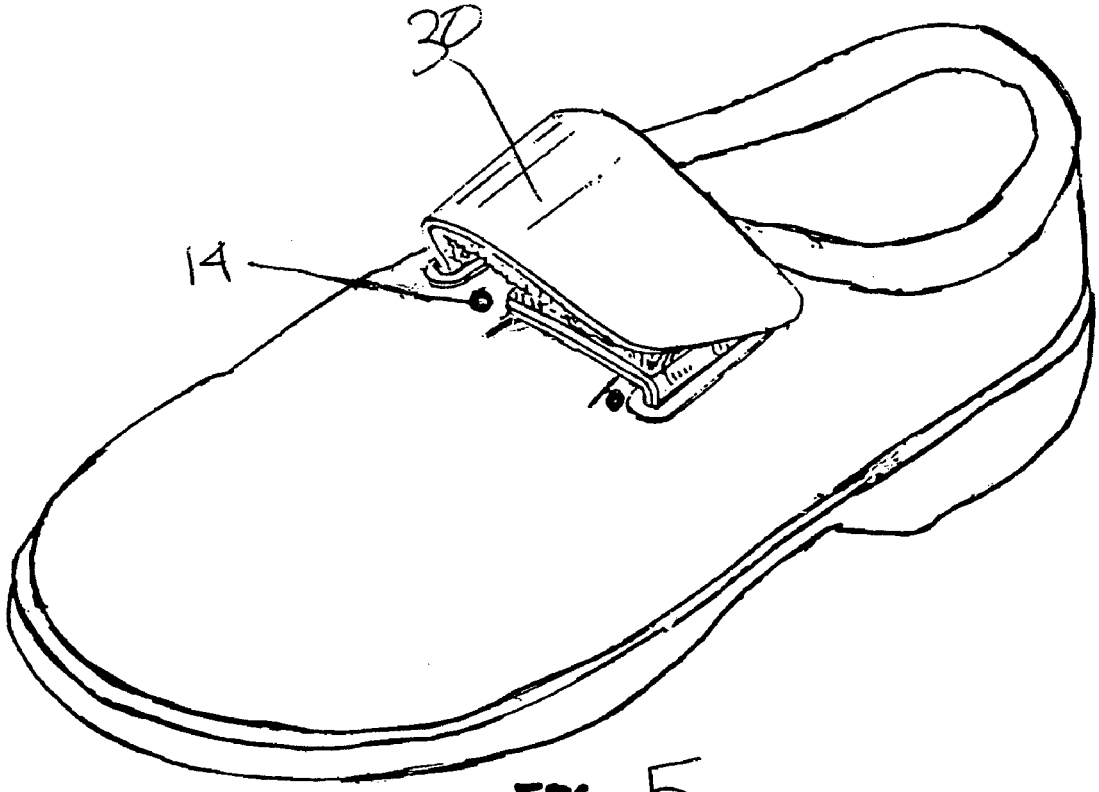
FIG. 5 is front perspective view of the advantageous embodiment according to FIG. 4.

FIG. 5 illustrates strap 30 in a closed position. Cord-receiving system 14 may at least partially remain visible but are largely covered by strap 30 in a closed position.

Figure 6:
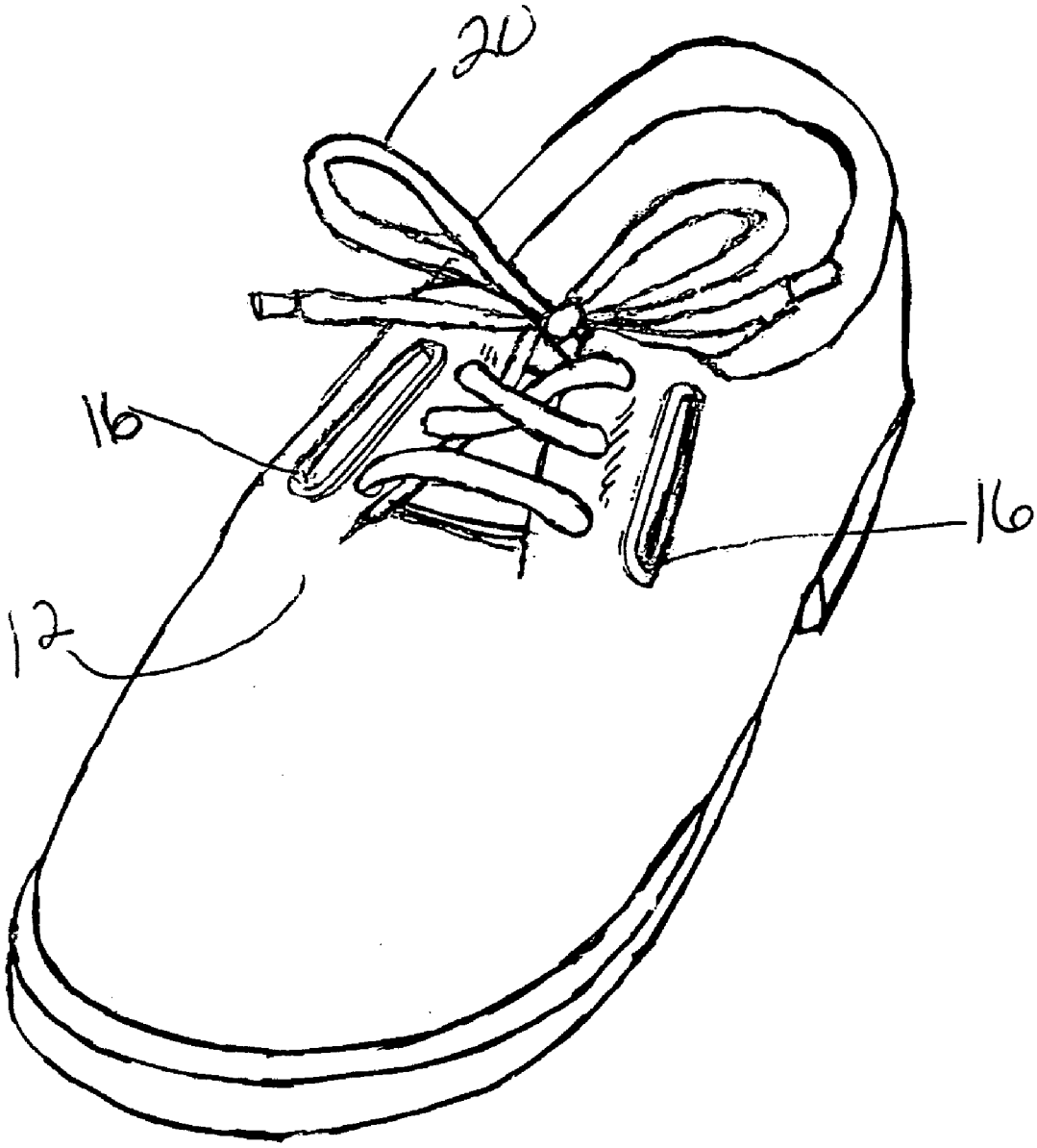
FIG. 6 is front perspective view of the advantageous embodiment according to FIG. 1 showing the strap removed.

FIG. 6 illustrates strap 30 removed and cord 20 in a closed position. In this embodiment, cord 20 alone is used to close shoe 10. While grommets 16 are disposed in upper 12 and provide the option of additionally engaging a strap, closure of shoe may be achieved by cord 20 alone.

Figure 7:
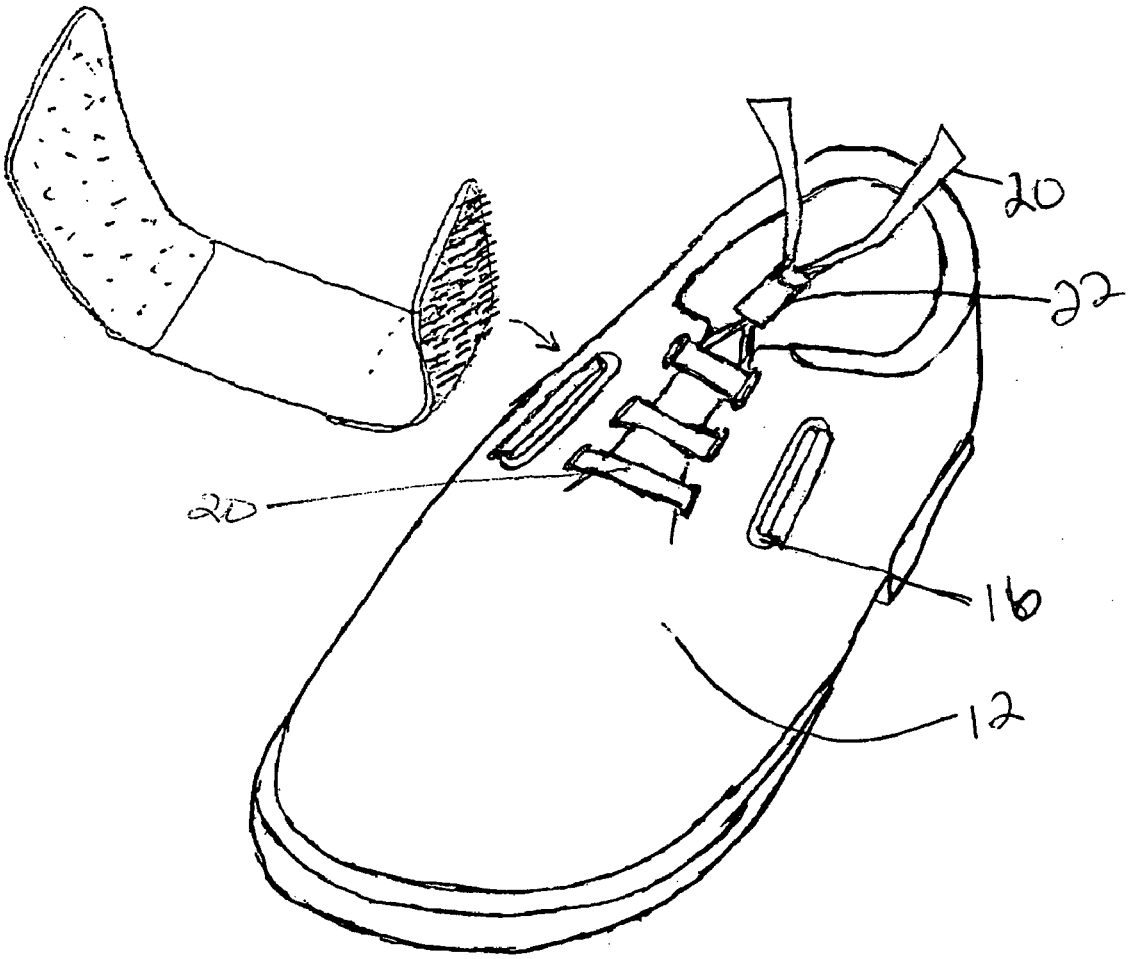
FIG. 7 is a front perspective view of the advantageous embodiment according to FIG. 1.

FIG. 7 illustrates another embodiment of the present invention. Cord 20 is held in a closed position by tension locking sleeve 22, rather than being tied or knotted. Grommets 16 are fixedly attached to upper 12 to receive strap 30. It is further understood that other strap-receiving devices comprising cord receiving system 14 such as D-rings may be fixed to and/or used with upper 12.

Figure 8:
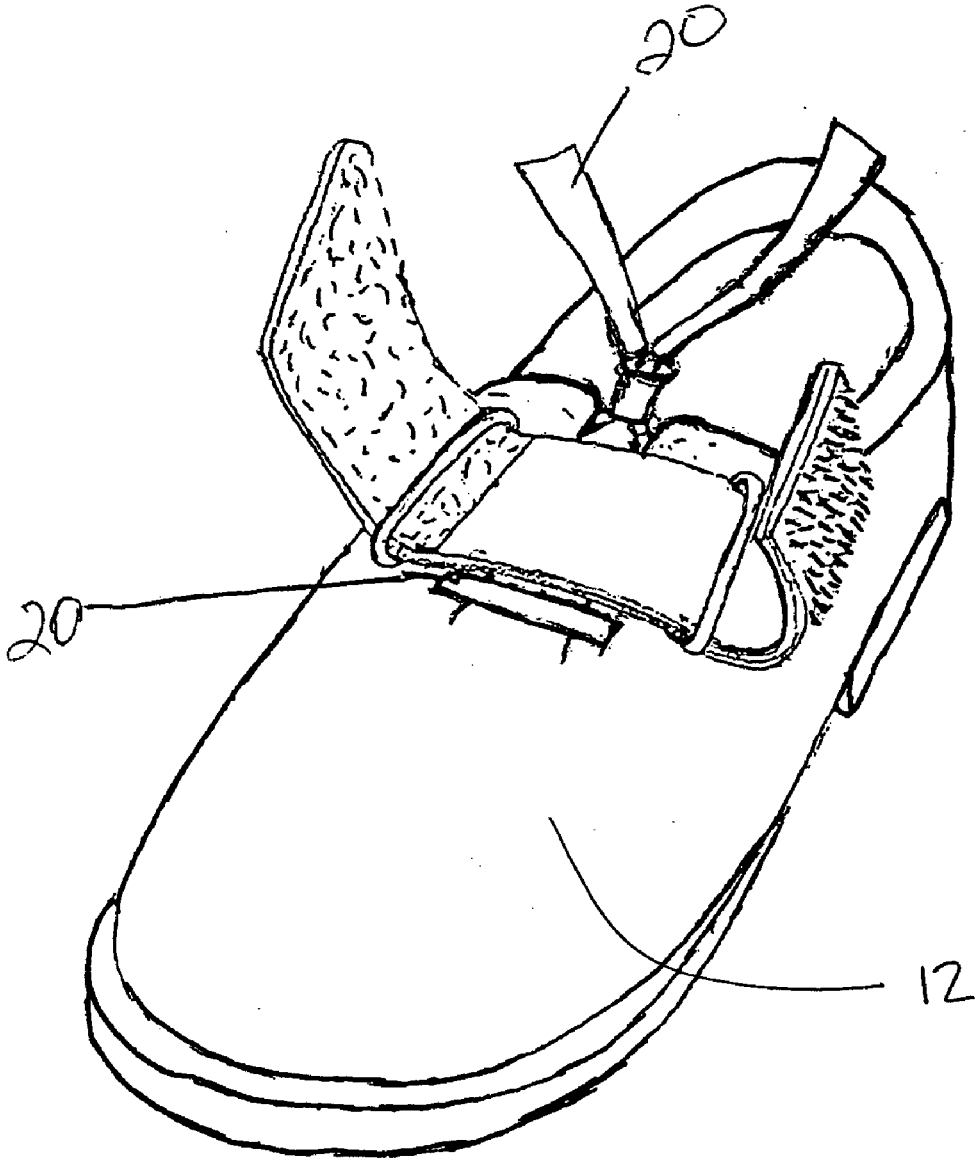
FIG. 8 is a front perspective view of the advantageous embodiment according to FIG. 1.

FIG. 8 illustrates strap 30 in an installed position. Strap 30 has been slid through loops 18 and rests on top of and covers cord 20.

A large benefit realized the previously discussed embodiment of the present is that it allows the user to buy a product with three option in one rather than purchase three separate shoes. In addition, the versatility allows for a more comfortable and custom fitted product for the user. For example, if the wearer wants to use either combination due to fashion concerns, they are available with simple adjustment of removing or attaching the cord 20 or strap 30 feature to the shoe 10. Alternatively, if the user has special footwear needs that may call for extra support or continuous adjusting of the upper to allow, for example, for swelling or removal/insertion of an orthopedic insert, the two features offer these options without need of changing shoes. The advantageous design further provides for features of concealing the inner adjustment system so that it can be used for sporting needs so extra security of cord will be in place so laces will not be undone or loosen or become snagged on external objects.

It is further contemplated that strap 30 may be designed in various differing forms and may be easily and quickly removed. This feature allows a single shoe 10 to utilize many various straps 30, which can alter the look and feel of the shoe 10. Various straps 30 may further be provided with designs, accessories attached thereto, or even shielding to cover the instep and/or top and sides of shoe 10 for protection while working. It is contemplated that a potentially infinite amount of designs may be associated with various straps 30 provided for attachment to shoe 10.

Still further, shoe 10 is very versatile in that one shoe 10 may be used for many different sporting activities. For example, shoe 10 with only cord 20 may be adequate for straight running activities, and by adding extra support for medial and lateral movement, such as is required in tennis and basketball, by adding the strapping system, the user may do cross training activities in the same product.

Figure 9:
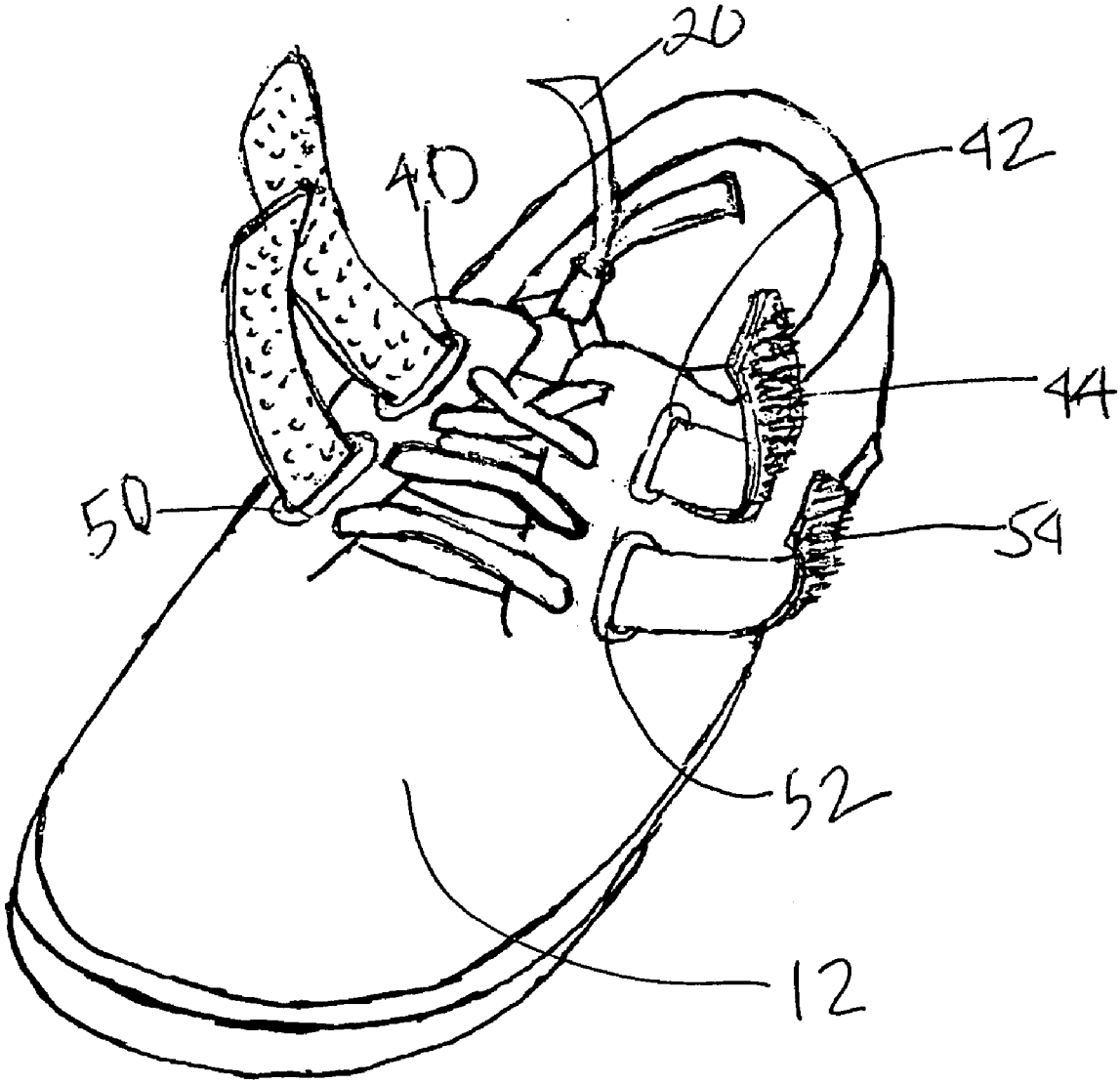
FIG. 9 is a front perspective view of another advantageous embodiment of the present invention.

FIG. 9 illustrates still another advantageous embodiment of the present invention with multiple removable straps slid through multiple sets of grommets in installed but open position. First set of grommets 40, 42 receives first strap 44, and second set of grommets 50, 52 receives second strap 54. Straps 44, 54 are disposed through upper 12 via their respective grommets, 40, 42, 50, 52. Alternatively, multiple straps 44, 54 may be received by multiple sets of loops or D-rings disposed in upper 12. Straps 44, 54 are again removable and one or both may be used to close shoe, alone or in addition to cord 20 providing yet more versatility to the user.

The various closure combinations possible allow the wearer to modify shoe closure at any time. Use of cord/lace alone provides a conventional shoe closure. Use of strap alone allows for easy closure without lacing, tying, and knotting. Use of cord and strap in combination provides extra support and closure assembly that has been doubly secured. A single shoe style meets the demand for both cord/lace closure and strap closure shoes.

As both cord and strap are removable, they may be customized by different cords, laces or ribbons, and straps of varying materials and styles for aesthetic, customized purposes, or to provide orthopedic comfort or the desired degree of support for the particular activity in which the wearer is engaged. There are advantages to retailers, buyers and customers by this invention because there can be a wide variety of options for after-market accessorizing of both aesthetic and functional straps.

Figure 10:
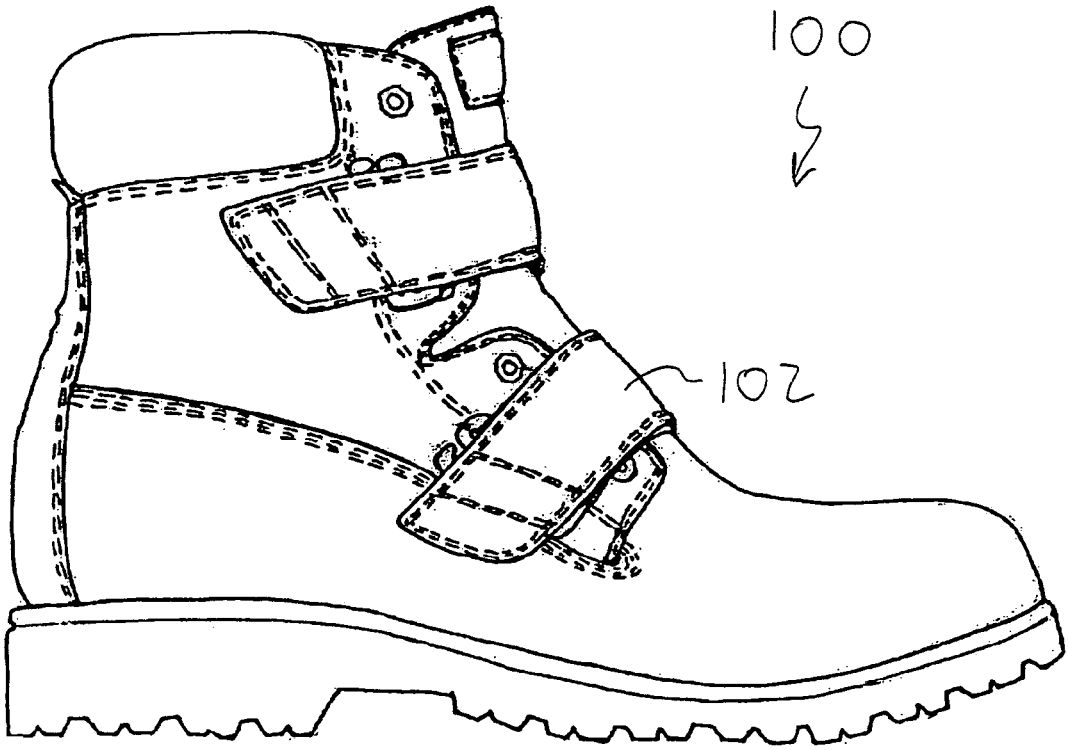
FIG. 10 is an illustration of still another advantageous embodiment of the present invention.
Figure 11:
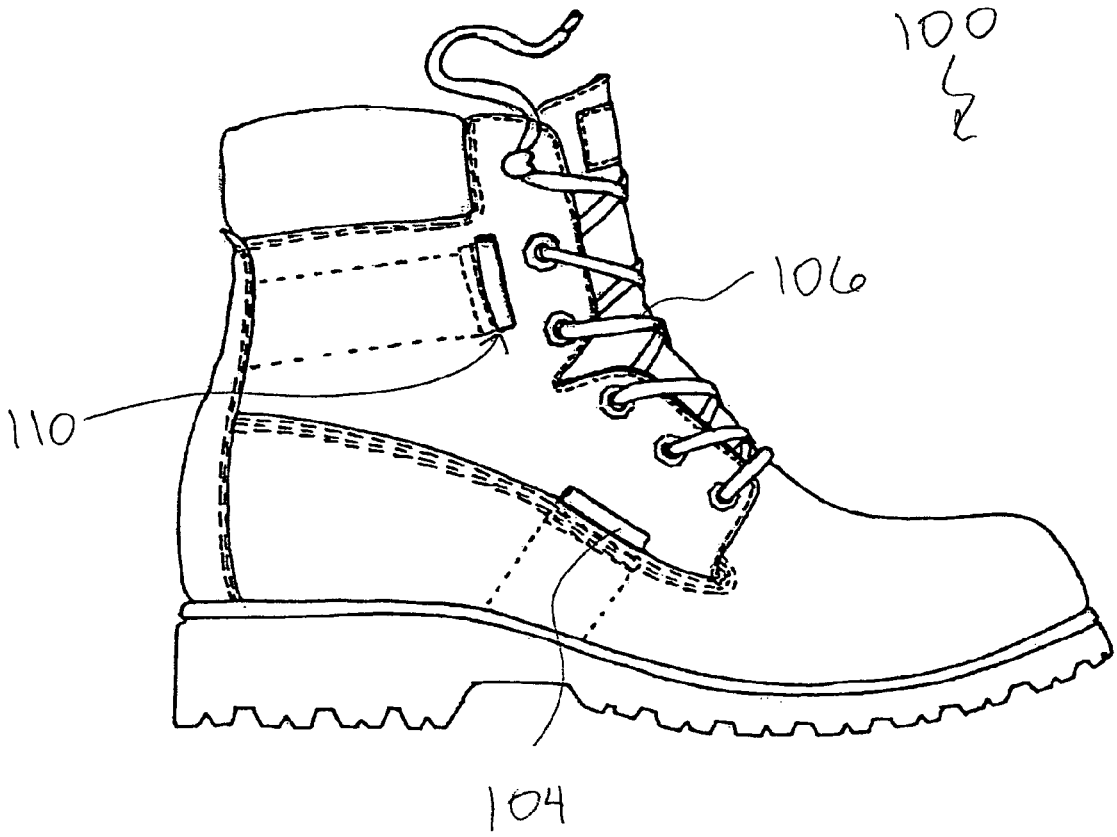
FIG. 11 is an illustration of the advantageous embodiment according to FIG. 10.
Figure 12:
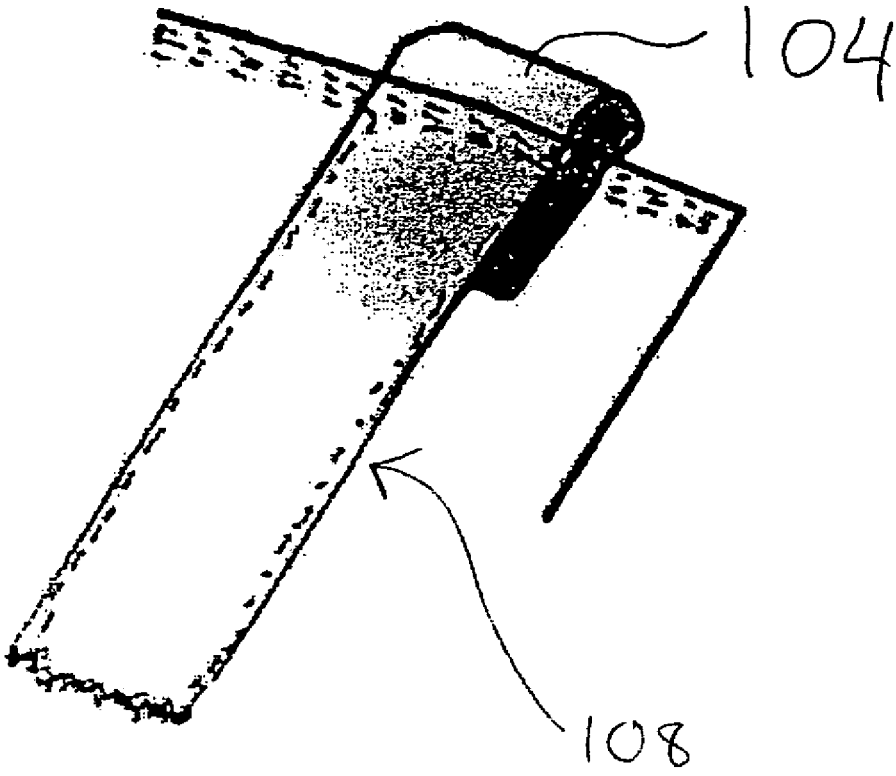
FIG. 12 is an illustration of the loop used in the advantageous embodiment according to FIG. 10.

Referring now to FIGS. 10-14 still another advantageous embodiment of the present invention is illustrated as footwear 100, with removeable straps 102 secured by loops 104 on both sides of the footwear. It should be noted that while two removeable straps 102 are illustrated, one or more than two may effectively be provided. Again, it is contemplated as illustrated in FIGS. 11 and 12 that footwear 100 may be used without straps 102, but instead is closed by cords 106.

FIG. 12 illustrates loop 104 in greater detail. Loop 104 is formed by a strip of material 108, such as for example, leather, that is attached to footwear 100. In one advantageous embodiment, loop 104 passes through slot 110 in the footwear. The strip 108 may be folded back upon itself and attached, forming loop 104, which is then secured in the slot 110.

Figure 13:
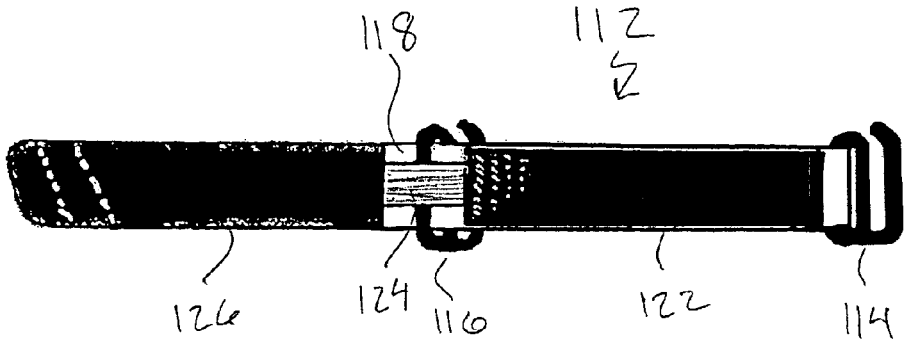
FIG. 13 is an illustration of the strap used in the advantageous embodiment according to FIG. 10.
Figure 14:
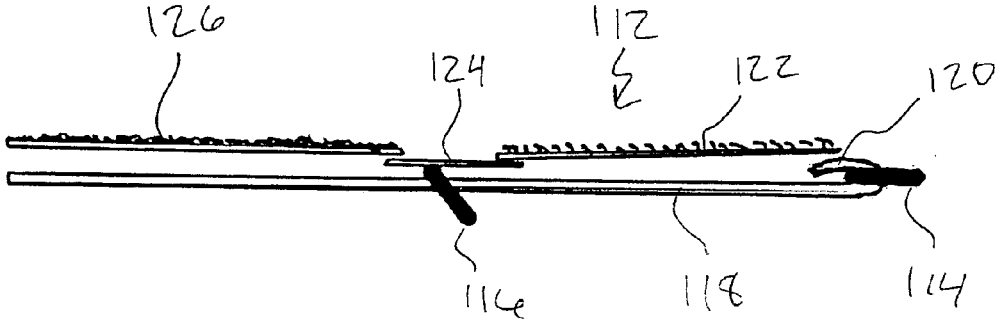
FIG. 14 is a further illustration of the strap used in the advantageous embodiment according to FIG. 10.

Turning now to FIGS. 13 and 14, a strap 112 is illustrated from a top view and a side view respectively. Strap 112 is provided with clasps 114, 116, which are each designed with a hook to engage with a respective loop 104 provided on each side of footwear 100. The first clasp 114 is fixed to one end of the strap 112, and the second clasp 116 is slideably retained on an intermediate portion of the strap 112.

Strap 112 is formed by a strip of material 118, such as for example, leather, that passes through elongate apertures formed in clasps 114. 116. The end 120 of material 118 is attached to a hook strip 122 that in turn may advantageously be attached to a connector strip 124 such as a ribbon, which also serves to retain the second clasp 116. On an opposite end, the connector strip of material 124 is further connected to a loop strip 126. The strap 112 is constructed in such a manner that the hooks on buckles 114, 116 can engage with loops 104. Once so engaged, strap 112 may then be folded back over on itself so that hook strip 126 comes in contact with loop strip 122 to secure closure of footwear 100.

Strap 112 is further provided such that the total length of strap 112 may be adjusted by the wearer simply by freeing the hook and loop strips and pulling on one end of strap 112 when strap 112 hooked to loops 104 providing further adjustability and comfort for the wearer.

As can be seen in FIGS. 10 and 11, the wearer is free to choose among a number various closure options. FIG. 10 illustrates footwear 100 with only the straps 102 being utilized for closure. FIG. 11 illustrates only cords 106 utilized for closure. It is further contemplated that both straps 102 and cords 106 may effectively be used as the closure system giving the user yet another option to choose from.

It is further contemplated that, as straps 102 are removeable, many differing straps may effectively be utilized in connection with footwear 100. While footwear 100 is illustrated as a boot, any type of footwear may effectively utilize this type of removeable/adjustable strap design. The straps 112 may be provided as coverings for the cords, or in a shoe design, may be provided to dress up or dress down the shoe depending upon the occasion. In any event, a user need only purchase a single shoe that may be utilized for many differing applications, the look and feel of the shoe being alterable based upon the selection of strap 102.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A piece of footwear comprising:

an upper having opposite sides;

at least one pair of loops fixed to said upper, each said pair comprising one said loop on each said side of said upper;

at least one strap having a pair of opposed ends and an intermediate portion;

a pair of clasps attached to each said strap, each said pair of clasps comprising a first clasp attached to one of said ends, and a second clasp slideably retained on said intermediate portion, each said clasp having a hook adapted to engage a respective said loop on said upper;

a hook strip attached to each said strap between one of said ends and said intermediate portion, and a loop strip attached to each said strap between the other of said ends and said intermediate portion, said hook strip and said loop strip together forming a hook and loop fastener, whereby, by engaging said hook of said first clasp to one loop of said pair, and by engaging said hook of said second clasp to the other loop of said pair, said strap may be drawn against said upper and retained in place by engaging said hook strip with said loop strip; and by disengaging said hooks from said loops, said strap may be completely removed from said upper.

2. The piece of footwear of claim 1 wherein said second clasp is formed with an elongate aperture, said intermediate portion of said strap being received through said elongate aperture of said second clasp.

3. The piece of footwear of claim 2 further comprising a connector strip which is secured to said intermediate portion of said strap over said elongate aperture.

4. The piece of footwear of claim 3 wherein said connector strip is secured to said strap oppositely from said hook of said second clasp, between said hook strip and said loop strip.

5. The piece of footwear of claim 4 wherein said connector strip has opposite ends attached to said hook strip and said loop strip, respectively.

6. The piece of footwear of claim 2 wherein said first clasp is formed with an elongate aperture, said one of said ends of said strap being received through elongate aperture of said first clasp.

7. The piece of footwear of claim 6 wherein said first clasp and said second clasp are at least substantially identical.

8. The piece of footwear of claim 1 wherein each said loop is formed by a strip of material which is folded back on itself and fixed to the upper.

9. The piece of footwear of claim 8 wherein said upper is formed with at least one slot, each said strip of material being secured in a respective said slot to form said loop.

10. The piece of footwear of claim 1 further comprising a cord system which serves as a closure for said footwear, each said pair of loops being fixed to said upper on either side of said cord system, whereby said straps provide a supplemental closure over said cord system.

* * * * *